United States Patent [19]

Cochran

[11] 3,971,653

[45] July 27, 1976

[54] CARBOTHERMIC PRODUCTION OF ALUMINUM

[75] Inventor: C. Norman Cochran, Oakmont, Pa.

[73] Assignee: Aluminum Company of America, Pittsburgh, Pa.

[22] Filed: Dec. 9, 1974

[21] Appl. No.: 530,656

[52] U.S. Cl. ..... 75/10 R; 75/68 A

[51] Int. Cl.[2] ..... C22D 7/02

[58] Field of Search ..... 75/68 R, 68 A, 10 R

[56] References Cited

UNITED STATES PATENTS

| | | | |
|---|---|---|---|
| 2,829,961 | 4/1958 | Miller et al. | 75/68 A |
| 2,974,032 | 3/1961 | Grunert et al. | 75/10 R |
| 3,723,093 | 3/1973 | Shiba et al. | 75/10 R |
| 3,758,289 | 9/1973 | Wood | 75/10 R |

*Primary Examiner*—M. J. Andrews

*Attorney, Agent, or Firm*—Daniel A. Sullivan, Jr.

[57] ABSTRACT

A process for producing aluminum, including the steps of forming from $Al_2O_3$ and C in the ratio one mol $Al_2O_3$ to 3 mols C, a first liquid of $Al_2O_3$ and $Al_4C_3$, creating in the first liquid a zone of increased temperature and/or decreased pressure to decompose the first liquid to a second liquid of Al and C, exhausting gases from the step of forming the first liquid without their passing through the second liquid, and recovering Al from the second liquid.

9 Claims, 8 Drawing Figures

PHASE DIAGRAM FOR Al-C SYSTEM

CALCULATED PHASE DIAGRAM FOR $Al_2O_3$–$Al_4C_3$ SYSTEM

CALCULATED COMPOSITIONS OF LIQUID 2 IN EQUILIBRIUM WITH LIQUID 1

PRESSURES AND VAPORIZATION LOSSES IN FORMATION OF LIQUID 1 FROM $Al_2O_3$ AND C (PLOTTED IN LIQUID 1 PHASE FIELD)

PRESSURES AND ALUMINUM BACK REACTION PLUS VAPORIZATION LOSSES FOR DECOMPOSITION OF LIQUID 1

PRESSURES AND ALUMINUM BACK REACTION PLUS VAPORIZATION LOSSES FOR REACTION OF LIQUID 1 WITH CARBON (DECOMPOSITION OF LIQUID 1 AS GOVERNING EQUILIBRIUM)

CARBOTHERMIC PRODUCTION OF ALUMINUM

FIELD OF THE INVENTION

The present invention relates to the production of aluminum metal through the use of carbon to reduce the oxygen-bound aluminum in $Al_2O_3$ to aluminum metal.

SUMMARY OF THE INVENTION

It is an object of the present invention to provide a new process for the production of aluminum by a reducing action of carbon on oxygen-bound aluminum in alumina.

This as well as other objectives which will become apparent in the discussion that follows are achieved, according to the present invention, by providing a process for producing aluminum, including the steps of forming from $Al_2O_3$ and C in the ratio one mol $Al_2O_3$ to 3 mols C, a first liquid of $Al_2O_3$ and $Al_4C_3$, creating in the first liquid a zone of increased temperature and/or decreased pressure to decompose the first liquid to a second liquid of Al and C, exhausting gases from the step of forming the first liquid without their passing through the second liquid, and rcovering Al from the second liquid.

ANALYTICAL FOUNDATION OF THE INVENTION

Synopsis

Figure 1:
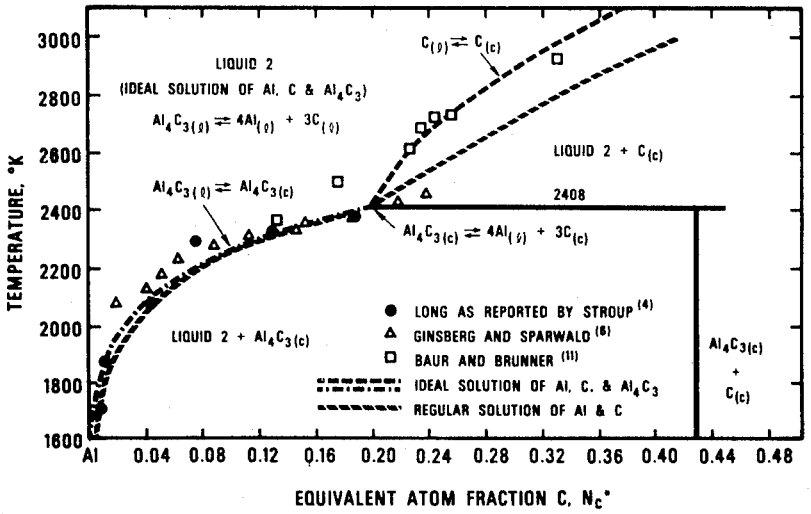
FIG. 1 is a phase diagram for the Al-C system.

Models derived from the Al-C and $Al_2O_3$-$Al_4C_3$ phase diagrams are used with thermochemical data to calculate the equilibrium between solid, liquid, and gas phases in carbothermic reduction of $Al_2O_3$ to Al. The initial liquid phase (Liquid 1) is approximated by an ideal solution of $Al_2O_3$, $Al_4C_3$, and a compound of these two $Al_4O_4C$. At one atmosphere total pressure Liquid 1 begins forming from solid $Al_2O_3$ and C at a temperature of about 2200°K. With an adequate heat supply the endothermic reaction continues at this temperature and Liquid 1 composition until either solid reactant is exhausted.

If excess C remains after all the $Al_2O_3$ is dissolved reaction of C with Liquid 1 further increases the $Al_4C_3$ content of Liquid 1 at one atmosphere pressure if the temperature is progressively increased. At about 2330°K and one atmosphere pressure the composition of Liquid 1 remains fixed and solid $Al_4C_3$ precipitates until either the C or Liquid 1 is exhausted. The loses of $Al_2O$ and Al vapors in the formation of Liquid 1 are very low at high $Al_2O_3$ concentrations and increased to about 10 percent of the reacting Al toward high $Al_4C_3$ concentrations in the Liquid 1 phase field.

Liquid 1 decomposes at higher temperatures to release CO and form a second liquid phase (Liquid 2) approximated by an ideal solution of Al, C, and $Al_4C_3$. The compositions of Liquid 2 in equilibrium with different compositions of Liquid 1 were derived by equating the activities of the component $Al_4C_3$ common to both liquid models. Liquid 2 can also form by decomposition of $Al_4C_3$ to form C along the liquidus line of Liquid 1 above 2408°K.

The Al yields are calculated on the most conservative basis by assuming all thermodynamically-favored back reactions go to completion in cooling the products from the reaction temperature and the back reaction products are not recycled. Thus, Al or $Al_2O$ vapors swept from the hot zone by CO evolved from Liquid 1 are assumed to completely back react with the CO upon cooling. Also, Liquid 2 and C formed by decomposition of $Al_4C_3$ in Liquid 1 are assumed to recombine to form $Al_4C_3$ upon cooling. This leaves the reaction of $Al_2O_3$ with $Al_4C_3$ in Liquid 1 as the only reaction resulting in net production of Al. Incomplete back reaction or recycling of back reaction products can increase the net yields above those based on these assumptions:

Vaporization can be minimized by staging the reaction so none of the CO evolved in forming Liquid 1 sweeps the zone where Liquid 2 forms. If all the C is used up in the initial reaction of $Al_2O_3$ and C to form Liquid 1, two-thirds of the overall CO will have been evolved before Liquid 1 is heated to the higher temperature where the contained $Al_2O_3$ and $Al_4C_3$ of Liquid 1 can react. This reduces the volume of CO sweeping through Liquid 1 that cause the critical vaporization losses. However, if some C (as from a contacts cntacts an excess of Liquid 1 at this higher temperature, the thermodynamically favored reducing agent for the $Al_2O_3$ in Liquid 1 will be C rather than the contained $Al_4C_3$ and the CO evolution and consequent vaporization losses will be much higher. With an excess of Liquid 1 the final equilibrium governing Al formation with C as the reducing agent for Liquid 1 is the reaction of $Al_2O_3$ with $Al_4C_3$.

Toward the high $Al_2O_3$ end of the Liquid 1 phase field the partial pressure of $Al_2O$ increases from decomposition reactions of Liquid 1. Also, the partial pressure of Al vapor is high for the compositions of Liquid 2 in equilibrium with Liquid 1 of high $Al_2O_3$ content. The resultant high vaporization losses consume all of the reduction products to prevent formation of Liquid 2 from Liquid 1 over much of the high $Al_2O_3$ end of the Liquid 1 phase field. Some vaporization can be tolerated without constituting a real material or energy loss if the product gases exit through a bed of the incoming reactant. The incoming reactants are preheated by the exiting CO and by condensation and back reaction of the $Al_2O$ and Al with CO. The minimum temperatures and total pressures calculated for the formation of Liquid 2 are 2150°K and 0.09 atm. in the decomposition of Liquid 1, and 2215°K and 0.25 atm. in the reaction of an excess of Liquid 1 with C. Toward the high $Al_4C_3$ end of the Liquid 1 phase field, the C content of the corresponding equilibrium compositions of Liquid 2 increases. The yields of Al for this region are decreased significantly by Al reacting with this C to form $Al_4C_3$ upon cooling Liquid 2. At compositions of Liquid 1 between these two extremes the sum total loss from vaporization and back reaction to $Al_4C_3$ is minimized. The lowest losses for pressures of one atmosphere or more should be obtained with the $Al_4C_3$ content a few percent below its solubility limit. The product losses from vaporization and carbide formation are about equal at this composition.

The total loss from vaporization or back reaction should decrease with increasing pressure and temperature through most of the composition range for Liquid 1. The lowest calculated loss for decomposition of Liquid 1 was 28% at 2800°K, the highest temperature considered, and pressures near 15 atm. For reaction of an excess of Liquid 1 with C the lowest calculated loss was 48% at 21 atm and 2800°K. At 2340°K, one atmosphere pressure, and an equivalent $Al_2O_3$, content of 83 mole % in Liquid 1, the calculated loss of Al is 61% if an excess of Liquid 1 reacts with C, and 34% if Liquid 1 decomposes. The decomposition of Liquid 1 is self-limiting unless (1) additions are made to the charge to compensate for the shift in composition caused by reaction, (2) the temperature is successively increased, or (3) the pressure continually decreased.

Published experimental vaporization losses and temperatures and compositions for formation of Liquid 2 are for the most part close to those calculated in this work for reaction of Liquid 1 with C. This is because C containers were employed and the reactants were usually heated rapidly to the final temperature without reaction staging.

INTRODUCTION

Interest in carbothermic reduction of $Al_2O_3$ is evidenced by the many papers [1-10, 12-18] published on this subject in recent years. A comprehensive review of the earlier literature can be obtained from Foster, Long, and Hunter[1], Motzfeldt[3], Stroup[4], Tarashchuk[5], and Ginsberg and Sparwald[6]. Two papers[8,9] have dealt with calculated equilibriums for the carbothermic reduction of $Al_2O_3$ at temperatures below 1800°C and 2100°K, respectively, but not in the range above 2100°K where a liquid Al-bearing phase can be produced[4-6]. In the present work, Al yields were calculated for different pressures and compositions in this higher range of temperatures.

Stroup described the work of Foster in which two liquid phases formed above 2250°K in the carbothermic reduction of $Al_2O_3$ when the $C/Al_2O_3$ ratio was carefully controlled. Frozen samples of the first liquid phase (Liquid 1) to form contained $Al_2O_3$ and $Al_4C_3$ as well as oxycarbide resulting from combination of $Al_2O_3$ and $Al_4C_3$, while frozen samples of the less dense of the two phases (Liquid 2) contained Al and $Al_4C_3$. Gitlesen, Herstad, and Motzfeldt[2] clarified the phase diagram of the $Al_2O_3$-$Al_4C_3$ system which contains Liquid 1, and the phase diagram of the Al-C system which contains Liquid 2, in showing that the only oxycarbide which forms in an $N_2$-free system is $Al_4O_4C$ and that solid $Al_4C_3$ decomposes to a liquid phase containing Al and C (Liquid 2) in equilibrium with solid carbon above 2408°K.

FORMULATION OF MODELS

Even though the limits of the equilibrium phase fields in these diagrams are not well established, it seemed worthwhile to develop thermodynamic models for Liquids 1 and 2 from tentative phase diagrams for the Al-C and $Al_2O_3$-$Al_4C_3$ systems and calculate the equilibriums between the vapor and liquid phases. This would provide a basis for predicting the effects of temperature, pressure, and composition on Al yields for comparison with the published experimental data.

An unsuccessful attempt was made to treat the liquid phases in the Al-C and $Al_2O_3$-$Al_4C_3$ systems as regular solutions obeying the relationship:

$$\log \frac{a}{N} = \frac{\alpha}{4.576T}(1-N)^2$$

where $a$ and $N$ are the activity and mole fraction of either component and $\alpha$ is a constant which applies to both components of the system. While this satisfactorily represented the liquidus line of Liquid 2 for temperatures below 2408°K, it missed most of the experimental points above this temperature as shown in FIG. 1.* In attempting to treat Liquid 1 as a regular solution of $Al_2O_3$ and $Al_4C_3$, the calculated activity of $Al_4C_3$ at the $Al_4O_4C$-$Al_2O_3$ peritectic point was about ten orders of magnitude too low.**

*A concentration of 20 atom percent C in Al was assumed to be in equilibrium with $Al_4C_{3(c)}$ and $C_{(c)}$ at 2408°K. From the activity of carbon (0.1076 as calculated under the "Al-C System"), $\alpha = -4{,}650$, $a_{Al(l)} = 0.770$, and $\Delta H_f\ 298 = -48.1$ kcal/mole for $Al_4C_{3(c)}$.

**For a eutectic composition of 10 mole percent $Al_4C_3$ at 2143°K, $a_{Al_2O_{3(l)}} = 0.610$, $\alpha = -155{,}000$, and $a_{Al_4C_{3(l)}} = 2\times10^{-14}$. For the peritectic reaction at 2223°K with solid $Al_4C_3$ present, $a_{Al_4C_{3(l)}} = 2\times10^{-12}$. If the melting point of $Al_4C_3$ is 3220°K, $a_{Al_4C_3} = 0.02$ at the 2223°K peritectic point. Unless the melting point of $Al_4C_3$ greatly exceeds 3220°K, the value of $2\times10^{-12}$ for $a_{Al_4C_3}$ is ten orders of magnitude too low.

Figure 2:
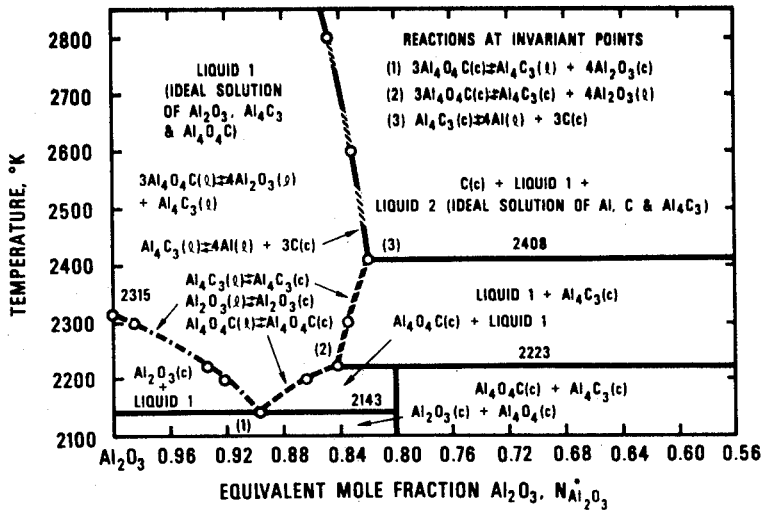
FIG. 2 is a calculated phase diagram for the $Al_2O_3$-$Al_4C_3$ system.

The liquid phases in the Al-C and $Al_2O_3$-$Al_4C_3$ systems were approximated by models consisting of ideal solutions of every species shown precipitating from these liquids in the phase diagrams given by Gitlesen, Herstad, and Motzfeldt[2] for these systems. Thus, Liquid 2 was approximated by an ideal solution of Al, C, and $Al_4C_3$, and Liquid 1 by an ideal solution of $Al_2O_3$, $Al_4C_3$, and $Al_4O_4C$. The small, nonideal solubilities of Al and C in Liquid 1 and $Al_2O_3$ and $Al_4O_4C$ in Liquid 2 and the consequent effect on liquidus temperatures are neglected. While the species in these models may not represent the actual ones present, the models meet two critical tests: first, the liquidus lines calculated from these models agree with the experimental ones (see FIGS. 1 and 2), and second, the heats of formation for $Al_4C_3$ and $Al_4O_4C$ calculated from these models and the phase diagrams agree quite well with measured values (see Table I). With these tests for reasonableness, the models were used as the basis for calculating the reduction equilibria between the gaseous and liquid phases.

CALCULATIONS OF THERMOCHEMICAL DATA FROM PHASE DIAGRAMS

Only the general approach will be described since space does not permit a detailed account of these calculations.

Liquid 2

The Clausius-Clapeyron equation was used to calculate the activity of liquid C in the liquid at the 2408°K peritectic point from estimated melting points and entropies of fusion. The activity of the $Al_4C_3$ and Al species in the liquid were obtained from the overall composition at this point and by assuming ideality in the liquid (activities add to unity). The association constant for Al and C to form $Al_4C_3$ in the liquid and the temperature dependence of this constant were then derived from these activities and estimated free energy functions and heats of formation from Table I. The relationships given in Table II were then used to derive the liquidus lines for the Al-C phase diagram shown in FIG. 1.

Liquid 1

Using free energy functions, heats of formation, and heats and entropies of fusion from Table I, expressions were written for the activities of $Al_2O_3$, $Al_4C_3$, and $Al_4O_4C$ in the liquid at the $Al_2O_3$-$Al_4O_4C$ eutectic at 2143°, of $Al_4C_3$ and $Al_4O_4C$ in the liquid at the $Al_4O_4C$-$Al_4C_3$ peritectic of 2223°K, and of $Al_2O_3$ and $Al_4O_4C$ in the liquid at the 2408°K liquid demixing point. Values for heats of formation and melting of $Al_4O_4C$ that best matched these equations to the compositions of the eutectic and peritectic were derived assuming the activities of $Al_2O_3$, $Al_4C_3$, and $Al_4O_4C$ in Liquid 1 equaled their mole fractions. As shown in Table I, the resulting heat of formation for $Al_4O_4C_{(c)}$ was within 1.5 kcal of the values proposed by Herstad and Motzfeldt[19]. From these, the dissociation constant of $Al_4O_4C$ in the liquid and the liquidus line activity expressions listed in Table II were derived and used to construct the $Al_2O_3$-$Al_4C_3$ phase diagram of FIG. 2.

The tentative phase diagram offered by Gitlesen, Herstad, and Motzfeldt shows the equivalent mole fraction of $Al_2O_3$, $N^*_{Al_2O_3}$, = 0.72 at the 2408°K liquid demixing point compared to 0.82 by these calculations. However, the value of 0.72 may only be estimated as no measurements of compositions at the 2408°K point could have been obtained according to this model unless pressures near two atmospheres were employed as will be shown in FIGS. 5 and 6. These authors did not mention any work at pressures greater than one atmosphere.

The derived liquidus line above 2408°K invariant point turns back toward the alumina side as the temperature is increased. This behavior follows from the tendency for increased dissociation of $Al_4C_3$ to Al and C at higher temperatures in this model. The reported liquidus lines[1,2,6]) do not show this behavior but probably were not determined above 2340°K in any case. As will be shown in FIGS. 4 and 5 for this model, the total pressure of the system along the liquidus should exceed one atmosphere above 2340°K, and none of these workers are believed to have employed pressures greater than one atmosphere in their measurements. Determination of the liquidus line above one atmosphere pressure would be a critical test of the model used in these calculations.

EQUILIBRIUMS CONSIDERED BETWEEN LIQUID AND GASEOUS PHASES

When $Al_2O_{3(c)}$ and $C_{(c)}$ react to form Liquid 1, the temperature and composition of Liquid 1 remains fixed and the following equilibrium applies until either solid reactant is exhausted.

$$2Al_2O_{3(c)} + 9C_{(c)} \rightarrow Al_4C_{3(l)} + 6CO_{(g)} \quad (3)$$

Two-thirds of the overall CO for production of Al is evolved in this step. If all of the $Al_2O_{3(c)}$ is dissolved, any excess C can continue to react with Liquid 1 if the temperature is increased.

$$2Al_2O_{3(l)} + 9C_{(c)} \rightarrow Al_4C_{3(l)} + 6CO \quad (2)$$

Finally, $Al_4C_3$ or above 2408°K, its dissociation products, Liquid 2 and C, preciptate and the temperature and composition of Liquid 1 remain constant until all of the C or Liquid 1 is consumed. The dissociation equilibrium for $Al_4O_4C$ also applies in Liquid 1.

$$3Al_4O_4C(l) \rightarrow 4Al_2O_{3(l)} + Al_4C_{3(l)} \quad (3)$$

The partial pressures of $Al_{(g)}$ *and* $_{Al2}O(g)$ result from the following equilibria during the formation of Liquid 1.

$$Al_2O_{3(l)} + 3C_{(c)} \rightarrow 2Al_{(g)} + 3CO_{(g)} \quad (4)$$

$$Al_2O_{3(l)} + 2C_{(c)} \rightarrow Al_2O_{(g)} + 2CO_{(g)} \quad (5)$$

Formation of $AlO_{(g)}$ is negligible for these conditions.

Figure 3:
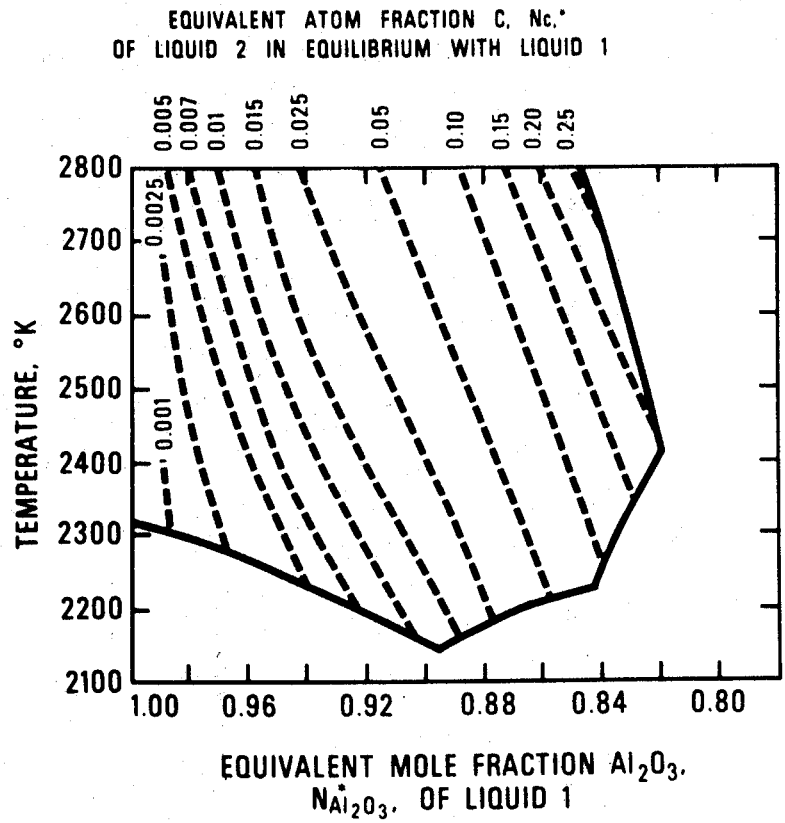
FIGS. 3 to 6 are modifications of FIG. 2.

At slightly higher temperatures than required to form Liquid 1, Liquid 1 decomposes to form Liquid 2 with evolution of the remaining one-third of the overall CO. Vaporization of the Al by the evolved CO prevents the complete range of Liquid 1 – Liquid 2 equilibrium compositions in FIG. 3 from being realized.

Previous experimental work[4,6] on carbothermic reduction of alumina has shown that much of the product is lost by vaporization and that equilibrium between the condensed and gas phases is critical in determining the conditions for formation of Liquid 2 from Liquid 1.

The equilibriums between the components of the gaseous and liquid phases that apply in the formation of Liquid 2 from Liquid 1 are those of Equations 3, 6, 7, and 8. These are not necessarily intended to represent actual steps in the process but rather to specify the overall equilibrium.

$$Al_2O_{3(l)} + Al_4C_{3(l)} \rightleftarrows 6Al_{(g)} + 3CO_{(g)} \quad (6)$$

$$4Al_{(g)} + Al_2O_{3(l)} \leftrightarrows 3Al_2O_{(g)} \quad (7)$$

$$Al_4C_{3(l)} \rightleftarrows 4Al_{(l)} + 3C_{(L)} \quad (8)$$

Many other valid equations can be written to represent the equilibriums between these materials; however, all of these can be obtained by various combinations of those listed and, thus, are automatically considered in this treatment. For example, the reaction commonly used to represent the production of Al by carbothermic reduction, $$Al_4O_4C + Al_4C_3 \rightarrow 8Al + 4CO \quad (9)$$

can be obtained from Reactions 3 and 6:

$$\tfrac{1}{3}(3) + 4/3(6) = (9)$$

The products obtained should depend on whether the equilibrium reaction is Case (1) decomposition of Liquid 1, Case (2) reaction of Liquid 1 (present in excess) with C, or Case (3) reaction of Liquid 1 with C (present in excess). In the latter case, the most favored product is $Al_4C_3$, or above 2408°K, the dissociation products of $Al_4C_3$, Liquid 2 and C. This results in no net aluminum production because Liquid 2 and the excess C are assumed to back react completely to $Al_4C_3$ upon cooling. The ultimate equilibrium that apply for Cases (1) and (2) are the same; namely, the equilibrium constants for Reactions 3, 6, 7, and 8. However, the relative amount of $CO_{(g)}$ that forms for Case (2) will be much greater than for Case (1). If the additional CO for Case (2) is evolved at the same time as Reactions 6 through 8 occur, the relative amounts of $Al_{(g)}$, $Al_2O_{(g)}$, and Liquid 2 produced will increase. This condition would apply if the rate-determining step is the rate at which C or the initial product of the C-Liquid 1 reaction (propably $Al_4C_3$) becomes available for reaction with Liquid 1. This might be the case for Liquid 1 reacting with C in its own container. The path of the C from the container to Liquid 1 could involve the C dissolving first in Liquid 2 and then diffusing through Liquid 2 and across the Liquid 2 – Liquid 1 interface to Liquid 1.

Values of $a_{Al_2O_3}$ were assumed in solving for the equilibrium compositions in forming Liquids 1 and 2. For each value of $a_{Al_2O_3}$ in formation of Liquid 1 from $Al_2O_3$ and C, there are five unknowns, $a_{Al_4C_3}$, $a_{Al_4O_4C}$, $p_{CO}$, $P_{Al_2O}$, and $p_{Al}$. The equilibrium expressions for Equations 1 or 2 and 3, 4, and 5 are used in solving for these along with the fact that the sum of the activities of the components of Liquid 1 is one. For each value of $a_{Al_2O_3}$ in formation of Liquid 2 from Liquid 1, there were six unknowns to solve for: three activities, $a_{Al_4C_3}$, $a_{Al_4O_4C}$, and $a_C$; and three partial pressures, $p_{Al}$, $p_{Al_2O}$, and $p_{CO}$. The values of $a_{Al}$ is not listed as an unknown because $a_{Al} = p_{Al}/p^{\circ}_{Al}$ where $p^{\circ}_{Al}$ is the vapor pressure of pure Al. Two other relationships in addition to the expressions for the equilibrium constants of Equations 3, 6, 7 and 8 were required for mathematical solution. The additional relationships were that the sums of the activities of the species in the models of the two liquid phases are unity. These follow from the assumption of an ideal solution.

For each solution, values were calculated for the total pressure of the products; $f$, the fraction of reacting Al lost by vaporization or back reaction; $N^*_{Al_2O_3}$, the equivalent mole fractions of $Al_2O_3$ in Liquid 1; $N^*_{Al}$, the equivalent mole fraction of Al in Liquid 2; and the equivalent mole fractions of $Al_2O_3$ consumed by the reaction. Details of the calculation are not given but can be obtained from the author. The term "reacting Al" is defined as all Al combined or free, which leaves Liquid 1 to enter Liquid 2 or the gas phase as reaction proceeds. This includes $Al_{(l)}$, $Al_{(g)}$, $Al_2O_{(g)}$, and $Al_4C_{3(l)}$.

VAPORIZATION OF Al AND $Al_2O$ AND BACK REACTION

All possible back reactions upon cooling the charge were assumed to go to completion in calculating the fractions of Al lost by vaporization or back reaction. Thus, only the Al which is thermodynamically stable in the cool reacted charge is considered in calculating the yield. If the back reaction products are totally returned to be reacted again, back reaction represents only a heat rather than a product loss unless the instantaneous fraction of reacting aluminum lost by back reaction is 1.00.

Besides the metallic aluminum which forms, aluminum leaves Liquid 1 as Al vapor, as the gaseous suboxide $Al_2O$ formed by Reaction 3, and as the $Al_4C_3$ entering Liquid 2. It is assumed that the vapors condense in a cooler zone and back react completely with the CO or are swept into the exhaust gases and not reclaimed. If back reaction is not complete and the Al condensing in the cooler zone is reclaimed, the losses will be less than the values calculated in this work.

The phase diagrams show that $Al_4C_3$ dissociates to an Al-C liquid phase and solid carbon about 2408°K. This is assumed to reassociate completely to $Al_4C_3$ in cooling the charge, and thus does not contribute to the Al yield.

At the boundary of the area of temperatures and compositions for producing Liquid 2 in a plot of the composition of Liquid 1 (see FIGS. 5 and 6) against temperature, $f = 1$, and the equilibrium CO pressure is given by the expressions below with the Al pressure equal to its condensation pressure in Liquid 2.

$$p_{CO} = \frac{p_{Al} + 4/3\,p_{Al_2O}}{2}$$

(Liquid 2 forms by decomposition of Liquid 1)

$$p_{CO} = 3/2\,p_{Al} + 2p_{Al_2O}$$

(Liquid 2 forms by reaction of an excess of Liquid 1 with C)

All of the reacting Al vaporizes for this condition, but a small amount of Liquid 1 begins to form at slightly higher temperatures or slightly lower $Al_2O_3$ contents for Liquid 1. For all temperatures below this value and compositions higher in $Al_2O_3$ content, all of the reacting Al vaporizes, and the equilibrium Al pressure is less than the Al condensation pressure in Liquid 2. The Al pressure for this case is calculated along with the pressures of $Al_2O$ and CO by using the above relationships in the overall solution of the equations.

OVERALL COMPOSITION OF LIQUID PHASES

The activities were converted to values of $N^*_{Al_2O_3}$ (the equivalent mole fractions of $Al_2O_3$ in the $Al_2O_3$-$Al_4C_3$ system) and $N^*_C$ (the equivalent atom fractions of C in the Al-C system) by the expressions given below:

$$N^*_{Al_2O_3} = \frac{3a_{Al_2O_3} + 4a_{Al_4O_4C}}{3a_{Al_2O_3} + 3a_{Al_4C_3} + 5a_{Al_4O_4C}}$$

$$N^*_C = \frac{a_C + 3a_{Al_4C_3}}{a_C + 7a_{Al_4C_3} + p_{Al}/P_{Al}}$$

GRAPHICAL PRESENTATION OF CALCULATED DATA

Figure 4:
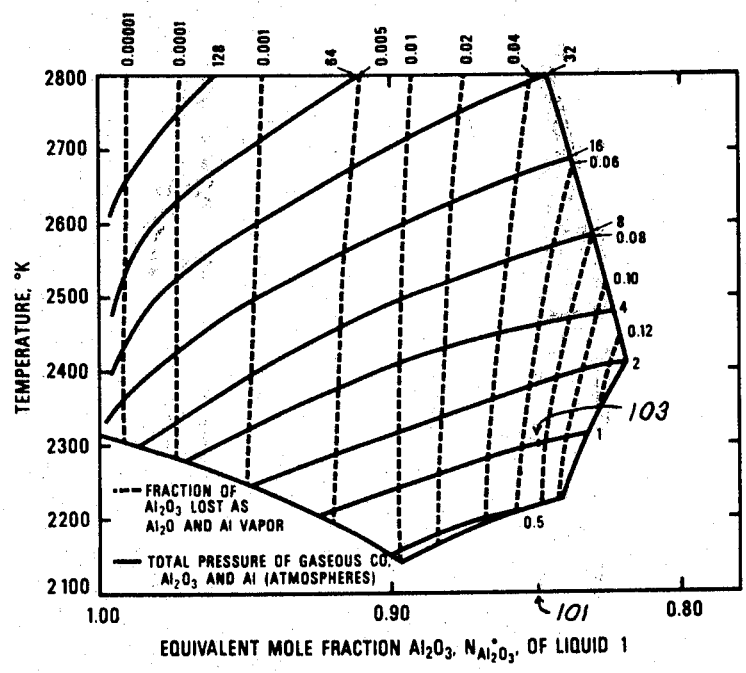
Figure 5:
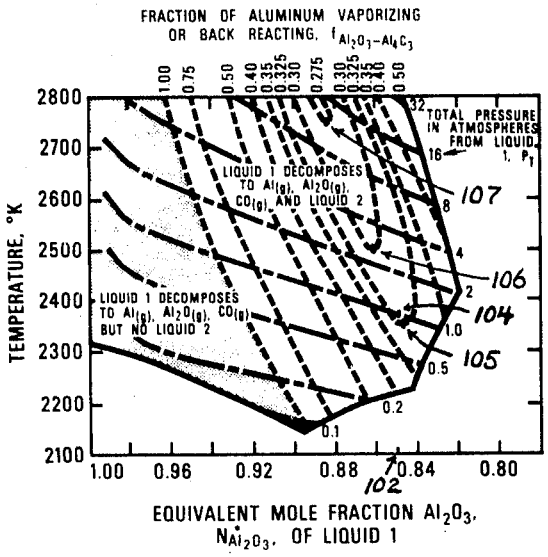
Figure 6:
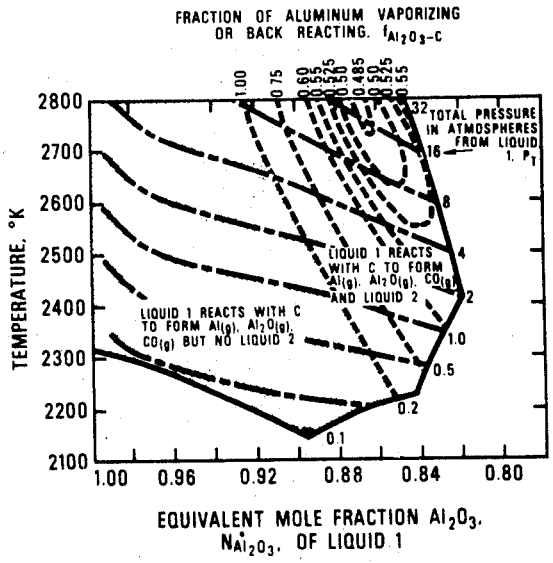

Compositions and temperatures with the same aluminum losses or total pressures in the formation or further reactions of Liquid 1 are connected by lines in the Liquid 1 phase field of the calculated phase diagram for the $Al_2O_3$-$Al_4C_3$ system in FIGS. 4, 5, and 6. FIG. 4 is for formation of Liquid 1 from $Al_2O_3$ and C. FIG. 5 is for the case of Liquid 1 simply decomposing to $Al_{(g)}$, $Al_2O_{(g)}$, and $CO_{(g)}$ with and without formation of Liquid 2. FIG. 6 is for the case that an excess of Liquid 1 reacts with C (different stoichiometry than for FIG. 5), but the governing equilibrium reaction is the same as for FIG. 5. FIG. 6 applies when C is consumed in a reaction with Liquid 1 to form CO and convert $Al_2O_3$ to $Al_4O_4C$ (or $Al_4C_3$) and $Al_4O_4C$ to $Al_4C_3$. The CO evolved in this reaction causes additional vaporization losses of Al and $Al_2O$ in the ensuing reaction of the newly made $Al_4O_4C$ and $Al_4C_3$ in Liquid 1.

The partial pressures of $Al_2O$ and Al vapors in the formation of Liquid 1 in FIG. 4 are very low at the high $Al_2O_3$ concentrations (the beginning of the reaction to form Liquid 1) and increase to about ten percent of the reacting Al toward the high $Al_4C_3$ concentrations in the Liquid 1 phase field. At one atmosphere total pressure, Liquid 1 begins forming at abot 2200°K. With all the $Al_2O_3$dissolved, $Al_4C_3$ precipitates at about 2330°K in formation of Liquid 1 at one atmosphere pressure.

The reacting Liquid 1 is completely converted to gases with no formation of Liquid 2 for compositions and temperatures to the left of the line for $f = 1.00$ in the Liquid 1 phase field of FIGS. 5 and 6. The range of temperatures and compositions for formation of Liquid 2 is much larger when Liquid 1 decomposes rather than when an excess of Liquid 1 reacts with C. The lower losses of FIG. 5 can be realized with $Al_2O_3 + C$ as the initial reactants by employing a two-step process in which Liquid 1 is formed at lower temperatures and heated to higher temperatures to decompose to Liquid 2 after the free $Al_2O_3$ and C are exhausted. This might also be accomplished in a continuous reactor if there is countercurrent flow of reactants and product gases. In this way CO, evolved initially in the reaction of $Al_2O_3$ with C in the lower temperature zone, would not sweep through the higher temperature zone where Liquid 2 forms from Liquid 1. At temperatures below 2143°K, the products from the reduction of $Al_2O_3$ with C in the first step would be $Al_4O_4C_{(c)}$ or $Al_4C_{3(c)}$ rather than Liquid 1.

The minimum temperature for the formation of Liquid 2 by decomposition of Liquid 1 is 2150°K at a total pressure of 0.09 atmosphere with $N^*_{Al_2O_3} = 0.897$. For reaction of an excess of Liquid 1 with C, the minumum temperature for formation of Liquid 2 is 2215°K at a total pressure of 0.25 atmosphere with $N^*_{Al_2O_3} = 0.852$. Essentially all of the Al is lost as $Al_2O_{(g)}$ and $Al_{(g)}$ for these conditions, and the amount of Liquid 2 forming would be infinitesimally small.

The lowest temperature at which formation of Liquid 2 has been observed for excess of Liquid 1 reacting with C are 2253°K[4] and 2263°K[6], but the fraction losses were much less than 1; and thus, these temperatures should be well above the minimums calculated. The highest value of $N^*_{Al_2O_3}$ at which formation of Liquid 2 has been reported is 0.883 at 2293° to 2353°K (see data of Ginsberg and Sparwald in Table II). The lowest vaporization and back reaction losses for any given temperature or pressure are calculated for compositions very close to the liquidus line for reaction of an excess of Liquid 1 with C and at slightly lower $Al_4C_3$ contents for decomposition of Liquid 1. At 2340°K, one atmosphere pressure, and an equivalent $Al_2O_3$ content of 83 mole percent in Liquid 1, the fraction of reacting Al lost from vaporization or back reaction is 0.61 for reaction of an excess of Liquid 1 with C and 0.34 for decomposition of Liquid 1. The losses for a given composition decrease with increasing temperature and pressure except when the solubility limits for C and $Al_4C_3$ in Liquid 1 are being approached. The minimum fraction losses were obtained near 2800°K, the top end of the temperature range considered, with a value of 0.275 near $N^*_{Al_2O_3} = 0.885$ for decomposition of Liquid 1, and 0.485 near $N^*_{Al_2O_3} = 0.965$ for reaction of an excess of Liquid 1 with C.

EFFECT OF TEMPERATURE ON VAPORIZATION AND BACK REACTION LOSSES

The most surprising result of the calculations was that the vaporization and back reaction losses, $f$, decrease as temperature increases for most compositions of Liquid 1 inside the area for producing Liquid 2. This result is obtained whether Liquid 2 forms by decomposition of Liquid 1 or reaction of an excess of Liquid 1 with C. This result would be obtained even if the heats of formation of the reactants and products were changed by major amounts, although this would change the temperature required to reach a given value for $f$. At first, it would seem that vaporization losses should increase with temperature as the vapor pressure of Liquid 2 and the equilibrium pressures of $Al_2O$ increase with rising temperature. However, CO is formed in the same reactions as the Al and $Al_2O$, and a ratio between the equilibrium partial pressures of the CO, Al, and $Al_2O$, rather than the magnitude of the individual partial pressures, determine the value of $f$. Ignoring $Al_2O$ formation, the reaction stoichiometry, with no added free C requires that two additional gram atoms of Al form for each mole of CO. If the ratio of Al to CO pressures is less than two, the Al is not swept away as vapor with the CO as rapidly as it forms, and the excess Al combines with $Al_4C_3$ to form Liquid 2. The equilibrium calculations show that the Al pressure, far from being twice the CO pressure, is much less than the CO pressure for many of the cases calculated. With $Al_2O$ formation considered, the condition for formation of Liquid 2 by decomposition of Liquid 1 is $(p_{Al} + 2p_{Al_2O})/(p_{CO} + \frac{1}{3}p_{Al_2O}) < 2$. Part of the advantage of increased pressure and temperature in lowering vaporization losses is offset by the higher solubility of C in Liquid 2 at these temperatures. This C is assumed to be completely consumed in back reacting with the aluminum in Liquid 2 to form $Al_4C_3$ as the products are cooled.

If the pressure is kept constant as the temperature is increased, as for example in operating with the reactor vented to the atmosphere, the loss from vaporization or back reaction can increase instead of decrease as the temperature is increased. As reaction proceeds, the composition shifts to the left in FIGS. 5 and 6, and the temperature must be increased along the appropriate isobar to sustain the reaction. This will cause the loss from vaporization or back reaction to increase for pressures near or below one atmosphere.

COMPARISON WITH EXPERIMENTAL VAPORIZATION LOSSES

The calculated losses from vaporization or back reaction are compared with the data of Ginsberg and Sparwald and Long in Table III. The losses reported by Ginsberg and Sparwald do not include Al and C that have back reacted in Liquid 2 to form $Al_4C_3$ and, thus, should be lower than the values calculated in this work. In all but three of the nine values compared, the amounts of C or $Al_4C_3$ in the charge were sufficient to saturate the liquid with $Al_4C_3$. Since these tests were not conducted at pressures greater than one atmosphere, the liquid compositions would have to flollow the one atmosphere isobar to the reaction temperature if temperatures greater than 2340°K were employed, and the melt was initially saturated with $Al_4C_3$. For these cases, the calculated loss values for both the starting and end compositions on the isobar are listed. The theoretical losses from this work, omitting those in formation of Liquid 1, are listed in Table III for comparison with the experimental losses. Values for both decomposition of Liquid 1 and reaction of an excess of Liquid 1 with C are included since either one can apply depending on how the tests were run. All of the experiments were conducted in graphite containers, and this would imply the data for reaction of an excess of Liquid 1 with C might apply. However, a protective layer of $Al_4C_3$ might form over the graphite and keep it from participating further in the reaction. In some cases where C was added directly to the charge, the experimental losses came close to those calculated for decomposition of Liquid 1 without reaction with C. This is possible if the charge is heated to temperature slowly so that the C is first completely converted to $Al_4O_4C$ or $Al_4C_3$ at lower temperatures, and the graphite crucible is covered with a protective $Al_4C_3$ layer. In Long's work, the C-containing charges were rapidly heated to the reaction temperature, and the losses are in the range of those calculated for reaction of an excess of Liquid 1 with C.

SUSTAINING REACTION

The reactions of Liquid 1 will not be sustained unless additional reactants are supplied from outside this phase (including C from the container), the temperature continually increased, or the pressure continually reduced. The liquid composition always shifts to higher $Al_2O_3$ contents in FIGS. 5 and 6 as reaction proceeds unless the proper additions are made because the equivalent mole fraction $Al_2O_3$ of the reactants consumed is always less than $N^*_{Al_2O_3}$. The slope of the isobars in FIGS. 5 and 6 shows this shift in composition to the left will require continually decreasing pressures or increasing temperatures to maintain the reaction. In most cases, the fraction of Al lost from vaporization or back reaction will increase as a result. If a mixture of the right composition is added at the same rate as the reactants are comsumed, the amount and composition of the charge will not change and reaction will be sustained with the same loss of Al at the initial temperature and pressure.

The addition of C during the reaction can be used to hold the composition constant or drive it to the right, eventually using up Liquid 1. The loss values of FIG. 6 apply under these conditions. Most of the published experimental data for this reaction are partially, if not totally, for this case because carbon or graphite containers were employed for Liquid 1.

THE OPTIMUM ATMOSPHERIC PRESSURE PROCESS

The optimum atmospheric pressure process would consist of continuously adding $Al_2O_3$ and C in a 1 to 3 mole ratio to Liquid 1 at about 2320°K to form more Liquid 1 with evolution of two-thirds of the overall CO. Liquid 1 would then be heated to 2370°K where decomposition to Liquid 2 begins with evolution of the additional one-third of the overall CO. These reactions could occur concurrently in adjacent reactors connected with a sump through which Liquid 1 flows from the lower to the higher temperatures. This arrangement would prevent the CO from the first reaction zone from causing additional vaporization in the second zone. The Liquid 2 that forms would float on the top of more dense Liquid 1 in the higher temperature reactor.

POSSIBILITIES FOR FUTURE WORK

Many refinements in these calculations should be possible as better models for these liquid phases, improved thermochemical data for $Al_4O_4C_{(c)}$, $Al_2O_{(g)}$, and $Al_{(g)}$, and more accurate phase diagrams for the $Al_2O_3$-$Al_4C_3$ and Al-C systems become available. Attempts should be made to lower vaporization losses in future tests by avoiding reaction of Liquid 1 with C at the metal-producing temperatures. Determination of yields at elevated pressures and temperatures would be helpful, particularly if the composition of Liquid 1 can be held in the optimum range by making additions of reactants as reaction proceeds.

CONCLUSIONS

The experimental temperatures and charge compositions at which Al first appears in carbothermic reduction of $Al_2O_3$ and the yields and the conditions for which no Al is produced have been explained by equilibrium calculations. No condensed Al-containing phase forms when the Al is lost by reaction with carbon to form carbide and/or vaporized by CO reduction products leaving the reaction zone.

REFERENCES (1) L. M. Foster, G. Long, and M. S. Hunter, J. Am. Ceram. Soc., 1956, Vol. 39, pp 1–11.

(2) G. Gitlesen, O. Herstad, and K. Motzfeldt, Edited by T. Forland, K. Grjotheim, K. Motzfeldt, S. Urnes, "Selected Topics in High Temperature Chemistry," pp 179–196, Universitetsforlaget, Oslo, 1966.

(3) K. Motzfeldt, Tek, Ukeblad., 1962, Vol. 109, pp 1137–42.

(4) P. T. Stroup, Trans. Met. Soc. AIME, 1964, Vol. 230, pp 356–71.

(5) N. T. Taraschchuk, Tsvetn. Metal, 1964, Vol. 37, pp 46–52.

(6) H. Ginsberg and V. Sparwald, Aluminium, 1965, Vol. 41, pp 181–93.

(7) J. H. Cox and L. M. Pdgeon, Can. J. Chem., 1963, Vol. 41, pp 671–83.

(8) V. C. P. Morfopoulus, Can. Met. quart., 1964, Vol. 3, pp 95–116.

(9) W. L. Worrell, Can. Met. Quart., 1965, Vol. 4, pp 87–95.

(10) L. Marchesini and P. Lecis, Techica Italiana, 1968, Vol. 33, pp 237–44.

(11) E. Baur and R. Brunner, Z. Electrochem., 1934, Vol. 40, pp 154–8.

(12) V. M. Kozlov, N. S. Guseva, and V. N. Veretinskii, Zhurnal Prikladnoi Khimii, 1972, Vol. 45 (7), pp 1409–14.

(13) V. Brozek and F. Prosek, Chemicky Prumysl, 1965, Vol. 15 (9), pp 540–3.

(14) V. P. Elyutin, Izv. Vyssh. Ucheb. Zaved., Chern. Met., 1968, Vol. 11 (7), pp 5–10.

(15) M. R. Gomes, 1971, Metalurgia ABM (Assoc. Brasil. Metais), Vol. 27 (160), pp 181–91.

(16) N. E. Filonenko, I. V. Lavrov, and S. V. Andreeva, 1959, Dok. Akad. nauch S.S.S.R., Vol. 124 (1), pp 155–8.

(17) T. Kikuchi, S. Ochiai, T. Kurosawa, and T. Yagihashi, Trans. of the Japan Institute of Metals. Vol. 12, No. 1, January 1971, pp 55–67.

(18) B. E. Emlin, S. I. Khitrik, S. T. Rostovtsev, M. I. Gasik, S. N. Kilesso, and V. A. Manko, Soviet Nonferrous Metals Research, 1974, Vol. 1, No. 2, 82–86.

(19) Joint Army-Navy-Air Force Thermochemical Tables, Dow Thermal Research Laboratory, Dow Chemical Company, Midland, Michigan.

(20) O. Herstad and K. Motzfeldt, Apr. 29, 1966, Technical University of Norway, Trondheim, Norway.

TABLE I

FREE ENERGY FUNCTIONS AND HEATS OF FORMATION FOR PRODUCTS AND REACTANTS

Data for other species from JANAF Tables[18].

| | °K | $C_{(l)}$[1] | $Al_4C_{3(c)}$ | $Al_4O_4C_{(c)}$[2] | $Al_4O_4C_{(l)}$[1] | $Al_4C_{3(l)}$[1] |
|---|---|---|---|---|---|---|
| $\left(\frac{F_T - H_{298}}{T}\right)$ cal/deg | 1700 | 11.527 | 54.864 | 65.948 | 88.448 | 72.364 |
| | 1800 | 11.755 | 56.800 | 68.423 | 90.923 | 74.300 |
| | 1900 | 11.976 | 58.663 | 70.806 | 93.306 | 76.163 |
| | 2000 | 12.190 | 60.460 | 78.108 | 95.608 | 78.960 |
| | 2100 | 12.398 | 62.193 | 75.330 | 97.830 | 79.693 |
| | 2200 | 12.600 | 63.868 | 77.479 | 99.979 | 81.368 |
| | 2300 | 12.795 | 65.487 | 79.560 | 102.060 | 82.987 |
| | 2400 | 12.986 | 67.054 | 81.575 | 104.075 | 84.554 |
| | 2500 | 13.171 | 68.573 | 83.531 | 106.031 | 86.073 |
| | 2600 | 13.351 | 70.045 | 85.430 | 107.930 | 87.545 |
| | 2700 | 13.526 | 71.475 | 87.276 | 109.776 | 88.975 |
| | 2800 | 13.697 | 72.864 | 89.071 | 111.571 | 90.364 |
| | 2900 | 13.863 | 74.214 | | | 91.714 |
| | 3000 | 14.025 | 75.527 | | | |
| $-\Delta H^\circ_f$ (kcal/mole) values in parentheses are comparisons cited from literature | 298 | −26.8 | 46.27* (51.55±1.6)[18] | 553.54 (555.0)[19] | 501.30 | −10.08 |

(1) $-\left(\frac{F_T - H_{298}}{T}\right)_{(l)} = -\left(\frac{F_T - H_{298}}{T}\right)_{(c)} + \Delta S_m$, $\Delta S_m = 22.5$ for $Al_4O_4C$, $\Delta S_m = 17.5$ for $Al_4C_3$, $\Delta S_m = 6.7$ for C (2) $\left(\frac{F_T - H_{298}}{T}\right)_{Al_4O_4C_{(c)}} = 4/3\left(\frac{F_T - H_{298}}{T}\right)_{Al_2O_{3(c)}} + 1/3\left(\frac{F_T - H_{298}}{T}\right)_{Al_4C_{3(c)}}$

*This value derived from the Al-C phase diagram compares to −51.55 ± 1.6 kcal/mole from JANAF[18]. Even though the more negative heat of formation was obtained from definitive colorimetric data, the value of −46.27 kcal/mole was employed in these calculations for self consistency in the assumed models.

TABLE II

RELATIONSHIPS FOR CALCULATING ACTIVITIES OF COMPONENTS ALONG LIQUIDUS LINES AND IN LIQUID AT ANY TEMPERATURE ON COMPOSITION

Al—C System liquidus lines:

$\ln a_{Al_4C_3} = -\frac{56{,}350}{RT} + \frac{17.5}{R}$ aluminum melting point to 240°K precipitation point of $Al_4C_{3(c)}$ and $C_{(c)}$ $\ln a_{C_{(l)}} = -\frac{26{,}800}{RT} + \frac{6.7}{R}$ 2408°K precipitation points to melting point of C (4000°K)

for any composition or temperature in liquid:

$$\ln \frac{(a_{Al(l)})^4 (a_{C(l)})^3}{a_{Al_4C_3}} = -\frac{\Delta(F - H_{298})}{RT} - \frac{79{,}920}{RT}$$

$Al_2O_3$—$Al_4C_3$ System liquidus lines:

$\ln a_{Al_2O_{3(l)}} = -\Delta\left(\frac{F - H_{298}}{RT}\right)_{Al_2O_{3(l-c)}} - \frac{27{,}044}{RT}$ $Al_2O_3$ melting point (2315°K) to $Al_2O_3$—$Al_4O_4C$ eutectic (2143°K)

$\ln a_{Al_4O_4C_{(l)}} = -\frac{52{,}238}{RT} + \frac{22.5}{R}$ $Al_2O_3$—$Al_4O_4C$ eutectic (2143°K) to $Al_4O_4C$—$Al_4C_3$ peritectic (2223°K)

$\ln a_{Al_4C_{3(l)}} = -\frac{56.355}{RT} + \frac{17.5}{R}$ $Al_4O_4C$—$Al_4C_3$ peritectic (2223°K) to liquid demixing point (2408°K)

Above liquid demixing point (2408°K)

$\ln a_{Al_4C_{3(l)}} =$ same as calculated for Al—C system at these temperatures from $a_{C_{(l)}}$, the equilibrium constant for the Al—C liquid, and $a_{C_{(l)}} + a_{Al_4C_{3(l)}} + a_{Al_{(l)}}$ 1 for any composition or temperature in liquid:

$$\ln \frac{(a_{Al_4O_4C(l)})^3}{(a_{Al_2O_3(l)})^4 a_{Al_4C_3(l)}} = \frac{\Delta(F - H_{298})^*}{RT} - \frac{20{,}566}{RT}$$

*values from Table I and JANAF[18]

TABLE III

COMPARISON OF CALCULATED VAPORIZATION AND BACK REACTION LOSSES WITH EXPERIMENTAL DATA OF LONG (REPORTED BY STROUP[4]) AND GINSBERG AND SPARWALD[6]

| Charge Composition Wt. % (Balance $Al_2O_3$) | | °K | Calculated Liquid Composition $N^*_{Al_2O_3}$ | Vaporization and Back Reaction Loss: Experimental | This Work: Excess of Liq. 1 Reacting with C | This Work: Decomposition of Liq. 1 |
|---|---|---|---|---|---|---|
| Ginsberg and Sparwald | 10C | 2293 | 0.883 | 0.64[4] | 1.00 | 0.58 |
| | 10C | 2323 | 0.883 | 0.49[4] | 1.00 | 0.54 |
| | 10C | 2353 | 0.883 | 0.53[4] | 1.00 | 0.50 |
| | 25C | 2263 | 0.838[1] | 0.52[4] | 0.74 | 0.35 |
| | 40 $Al_4C_3$ | 2263 | 0.838[1] | 0.79[4] | 0.74 | 0.35 |
| | 40 $Al_4C_3$ | 2353 | 0.829[1]–0.840[2] | 0.62[4] | 0.65 | 0.33 |

TABLE III-continued

COMPARISON OF CALCULATED VAPORIZATION AND BACK REACTION LOSSES WITH EXPERIMENTAL DATA OF LONG (REPORTED BY STROUP[4]) AND GINSBERG AND SPARWALD[6]

| Charge Composition Wt. % (Balance $Al_2O_3$) | °K | Calculated Liquid Composition $N_{Al\ O}$ | Vaporization and Back Reaction Loss: Experimental | This Work: Excess of Liq. 1 Reacting with C | This Work: Decomposition of Liq. 1 |
|---|---|---|---|---|---|
| G. Long 16.5C | 2333 | 0.830[1] | 0.56[5] | 0.62 | 0.34 |
| G. Long 16.5C | 2381 | 0.829[1]–0.860[2,3] 0.945[2] | 0.70[5] | 0.61–0.78 | 0.34–0.34 |
| G. Long 16.5C | 2473 | 0.829[1] –0.927[3] | 0.83[5] | 0.61–1.00 | 0.34–0.88 |

[1] On liquidus line, saturated with $Al_4C_3$
[2] Composition when reaction ceases at 1 atmosphere total pressure — Reaction of an excess of Liquid 1 with C
[3] Composition when reaction ceases at 1 atmosphere total pressure — Decomposition of Liquid
[4] Considers only vaporization loss — given value = $\frac{X}{100 + X}$, where X is the value in Column VI, Table 5 of Ginsberg and Sparwald
[5] Calculated from free metal in charge at end of experiment

DESCRIPTION OF THE PREFERRED EMBODIMENTS

The present invention includes staging a continuous thermal process for reducing $Al_2O_3$ with C to conserve energy and limit vaporization of the aluminum product by the CO evolved in the reactions. The $Al_2O_3$-$Al_4C_3$ and Al-C liquid phases which form are maintained at fixed compositions which minimize the sum total product loss by vaporization and back reaction. These compositions are maintained by temperature control and adding $Al_2O_3$ and C to the $Al_2O_3$-$Al_4C_3$ liquid phase at rates equivalent to the rate of formation of the separate Al-C liquid phase.

The present invention involves a continuous thermal process for producing aluminum from carbon and alumina with minimum losses and energy. Production of aluminum by thermal processes avoids the inefficiency of electric power generation from thermal sources. Two reaction zones are employed at slightly different temperatures with the off-gas stream from the cooler zone not passing through the hotter zone and with the $Al_2O_3$-$Al_4C_3$ liquid communicating through the two zones. The reaction occurs in two steps at different temperatures. In the lower temperature zone, $Al_2O_3$ and C in a 1 to 3 mole ratio are continuously added to an $Al_2O_3$-$Al_4C_3$ liquid phase to form more of the liquid while evolving two-thirds of the overall CO for the aluminum-producing reaction. This liquid passes continuously to the second zone at slightly higher temperatures where the $Al_2O_3$-$Al_4C_3$ liquid decomposes, evolving the remaining one-third of the overall CO for the process and forming an Al-C liquid phase immiscible with and floating on the $Al_2O_3$-$Al_4C_3$ phase. The $Al_2O_3$-$Al_4C_3$ phase is kept at a fixed composition chosen to represent minimum total product losses from vaporization of $Al_2O$ and Al vapors in the CO stream (high at high $Al_2O_3$ contents) and back reaction of Al and C to form $Al_4C_3$ upon cooling the Al-C phase (high at high $Al_4C_3$ contents). Isolating the two effluent streams through the reactor zones cuts by two-thirds the amount of CO sweeping through the higher temperature zone where vapor losses are more critical. By adding $Al_2O_3$ and C to the lower temperature zone at a rate equivalent to the formation rate of the Al-C phase in the hotter zone, the constant $Al_2O_3$-$Al_4C_3$ composition can be maintained. At one atmosphere total pressure, the optimum temperature in the cooler zone should be near 2050°C while the temperature in the hotter zone should be near 2100°C. These temperatures and pressures fix the composition of the $Al_2O_3$-$Al_4C_3$ liquid which in turn fixes the composition of the Al-C phase. Higher temperatures are required for higher pressures. Surprisingly, vaporization losses decrease at the optimum compositions of the $Al_2O_3$-$Al_4C_3$ liquid as temperature and pressure are increased.

If the reactions are conducted in a staged batch process with first formation of the $Al_2O_3$-$Al_4C_3$ phase and later formation of the Al-C phase, the liquid phases pass through a range of compositions for which the total losses by vaporization and back reaction to $Al_4C_3$ are much higher than when the liquids are controlled at optimum compositions. For some of the liquid compositions, vaporization of products is complete and no Al-C phase forms. A degree of vaporization can be tolerated without constituting a real material or energy loss if the product gases exit through a bed of the incoming reactants. The reactants are preheated by the exiting CO and condensation of $Al_2O$ and Al and back reaction of these with CO (giving back the entire heat for their formation from $Al_2O_3$ and C). However, for cases with vaporization approaching 100%, there can be no net product formed and the heat carried to the incoming reactants far exceeds any need for preheating. In this case, the reaction is nothing more than a heat pipe carrying heat from the reactor to the preheater with the heat requirements for producing a unit of aluminum approaching infinity. Also, excessive vaporization, condensation, and back reaction can cause plugging of the off-gas streams that also disrupts the free flow of incoming reactants.

The Al-C phase is periodically tapped from the higher temperature zone. The $Al_4C_3$ that forms upon cooling the Al-C phase is returned to the higher temperature chamber to not constitute a material loss. The ratio of C to $Al_2O_3$ in the material added must not exceed that for producing Al. Any excess C as from container walls can react to convert Al to $Al_4C_3$. The CO gas product can be burned for preheating reactants or used as by-product low BTU gas. The reactions to form and decompose Liquid 1 are both endothermic. In today's technology, this heat could be supplied by resistive heating or arcs with adjustment of the C in the reactants for any C introduced directly from the electrodes. In the future, this energy might be supplied from nuclear reactors. The optimum composition of the $Al_2O_3$-$Al_4C_3$ phase for operation at one atmosphere pressure is a few mole percent less $Al_4C_3$ than the solubility limit of $Al_4C_3$ or its dissociation products at any temperature or pressure used. At one atmosphere pressure, this would be about 0.80 mole fraction $Al_4C_3$ in $Al_2O_3$.

In the present invention, $Al_4C_3$ is produced in the $Al_2O_3$-$Al_4C_3$ liquid in the lower temperature zone, $2\,Al_2O_3 + 9C \rightarrow Al_4C_3(l) + 6CO(g)$, to serve as the reducing agent for $Al_2O_3$ in the same liquid in the higher temperature zone, $Al_2O_3 + Al_4C_3 \rightarrow 6Al + 3CO(g)$. The overall reaction is $3Al_2O_3 + 9C \rightarrow 6Al + 9CO$ or $Al_2O_3 + 3C \rightarrow 2Al + 3CO$.

While Al(g) and $Al_2O(g)$ would be lost from the $Al_2O_3$-$Al_4C_3$ and Al-C liquids even if CO were not evolved, loss of these vapors is increased tremendously by the large volumes of CO released in the reduction reactions. It is assumed that the CO is saturated with these gases at their equilibrium partial pressures form the two liquids.

If arc furnace or resistive heat is employed, the overall process would not be completely thermal and would include the inefficiency of power generation.

In summary, the main features of the process are:

1. Operating continuously at specified ranges of composition and temperature.
2. Staging of reaction temperatures to limit the volume of CO that vaporizes product from the higher temperature zone.
3. Avoiding carbon excess.
4. Recovering volatiles and their heats of vaporization and heat of formation on the incoming reactants.
5. Recycling $Al_4C_3$ from Al-C liquid product.
6. Increasing pressure and temperature to further decrease vaporization.

Figure 7:
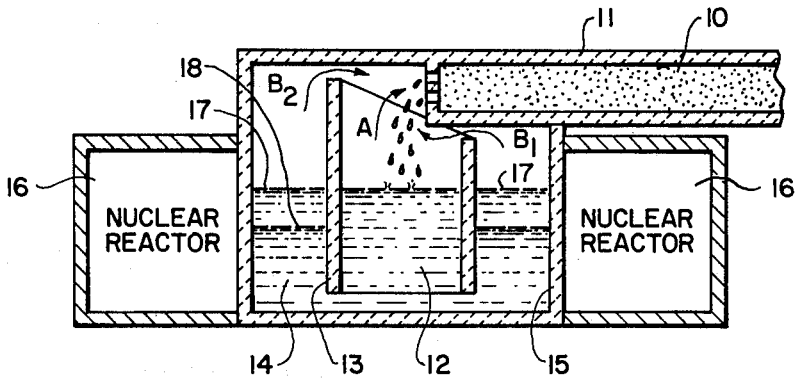
FIG. 7 is an elevational, schematic of one embodiment of the present invention.
Figure 8:
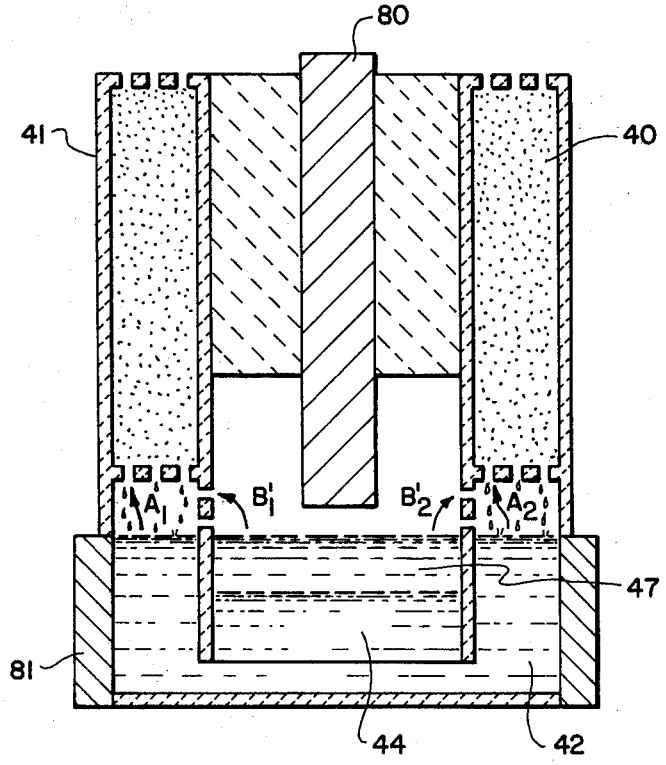
FIG. 8 is an elevational, schematic of a second embodiment of the present invention.

Exemplary embodiments of the present invention are illustrated in FIGS. 7 and 8. In FIG. 7, a charge 10 of particulate $Al_2O_3$ and carbon is moving through conduit 11 and then into a first liquid 12 of $Al_2O_3$ and $Al_4C_3$.

According to a preferred embodiment of the invention, the mol fraction $$\frac{Al_2O_3}{Al_2O_3 + Al_4C_3}$$

has in this first liquid 12 a value of 0.85, which occurs on the abscissa at point 101 in FIG. 4 and at point 102 in FIG. 5. This particular value has the advantage that loss of aluminum metal in gaseous form or back reacting is minimized when this first liquid 12 is caused to decompose at 1 atmosphere pressure into a second liquid of Al and C. First liquid 12 is continuous, under the barrier presented by tube 13, into zone 14 of increased temperature. Zone 14 is a single zone of doughnut shape and for this reason appears to the right and left in FIG. 7.

The increased temperature in zone 14 is caused in this embodiment by heat exchange through wall 15 from a nuclear reactor 16. The reactor is shown schematically, and the present state of the relevant technology would indicate that the heat from the reactor should actually be transferred to wall 15 through the interposition of a flowing, heat-carrying liquid.

At the increased temperature, the first liquid 12 decomposes in zone 14 to form second liquid 17 of aluminum and carbon. The second liquid floats on the first liquid, the upper surface of the first liquid being at level 18. There is no second liquid 17 within tube 13.

It should be noted here that the first liquid 12 and the second liquid 17 are referred to here and in the claims, for purposes of shorthand, as, respectively, of $Al_2O_3$ and $Al_4C_3$ and of Al and C. More details concerning these liquids appear in FIGS. 1 and 2, where the first liquid 12 is referred to as liquid 1 and the second liquid 17 is referred to as liquid 2.

As mentioned above, a preferred mol fraction $Al_2O_3$ to $Al_2O_3 + Al_4C_3$ in the first liquid 12 for operation at atmospheric pressure is 0.85. This ratio is achieved initially by charging to the region for containment of the first liquid 12 alumina and carbon in the ratio 0.85 mols $Al_2O_3$ to 1.00 mols C. This charge is heated to 2320°K, the preferred temperature in the central region of the first liquid 12 as shown in FIG. 7. In FIG. 4, we are then at point 103. Then the temperature of liquid 12 experiences an increase in zone 14 to 2370°K, to point 104 in FIG. 5, where the first liquid decomposes into the second liquid 17 with the relatively small "fraction of aluminum vaporizing or back reacting" of somewhat less than 0.325.

It will be noted in this example that operating parameters have been chosen such that the decomposition of the first liquid into the second liquid proceeds at the intersection of the locus of minima of the "fraction of aluminum vaporizing or back reacting" curves of FIG. 5 with the curve there for 1 atmosphere. This locus is a curve containing points 105, 106, and 107 of FIG. 5; the locus itself has not been drawn-in, in order to retain clarity in FIG. 5.

It will likewise be noted from FIG. 5 that, for a given pressure, it is advantageous to carry out the decomposition of the first liquid 12 to the second liquid 17 at the intersection of the locus of minima of the "fraction of aluminum vaporizing or back reacting" curves with the curve for the particular pressure reigning during the decomposition. It is furthermore apparent from FIG. 5 that it is preferable, in terms of further minimizing the "fraction of aluminum vaporizing or back reacting" to allow the decomposition of the first liquid to the second liquid to proceed at pressures above atmospheric pressure.

While the above-described example utilizes an increase in temperature, from 2320°K to 2370°K, to cause the first liquid 12 to decompose into the second liquid 17, it will be clear from a comparison of FIGS. 4 and 5 that the decomposition can be caused by decreasing the pressure over the first liquid.

The embodiment of FIG. 7 is continuous, with the second liquid 17 being tapped or siphoned continuously or from time to time, for the collection of aluminum product. The aluminum may be obtained from the second liquid 17 for example using methods as set forth in U.S. Pat. No. 2,829,961 issued Apr. 8, 1958 in the names of Mike A. Miller et al. With regard to the recovery of aluminum from the second liquid, the paragraph extending between column 3, line 65 and column 4, line 10 of that patent is incorporated here by reference. The $Al_4C_3$ by-product remaining from the Al collection may be recycled to zone 14.

While in the example given here, it is preferred for 1 atmosphere pressure operation that the mol fraction $Al_2O_3$ to $Al_2O_3 + Al_4C_3$ equal 0.85, once this composition has been obtained for the first liquid 12, the alumina and carbon charge is thenceforth provided in the ratio 1 mol $Al_2O_3$ to 3 mols C. This provides the right amount of carbon to completely reduce the oxygen-bound aluminum in $Al_2O_3$ to aluminum metal. This one to three ratio needed from the point of view of providing just the right amount of carbon to change all the oxygen-bound aluminum in the $Al_2O_3$ into aluminum metal will, in some forms of operation of the present invention, be departed from in the actual charge being fed into the first liquid 12. For instance, it may be desired to bring about and maintain the above-mentioned exemplary 2320°K temperature in the first liquid 12 by providing some additional carbon, this to be accompanied by the feeding of sufficient pure oxygen to burn such excess carbon for adding heat to the first liquid. This burning of some excess carbon using pure oxygen gas would, however, have the disadvantage that the gases sweeping out of the first liquid in the charging region would be correspondingly increased in volume and this could result in increased volatilization losses, although such losses may be bearable, since volatilization would be less in the 2320°K part of liquid 12, where this carbon burning would be occurring, than in the zone 14 of the higher, 2370°K temperature.

While sufficient carbon is charged to the lower temperature region of the first liquid 12 to completely consume the oxygen in the charged $Al_2O_3$ in the form of CO, not all of the CO is evolved from this lower temperature region. Rather, two-thirds of the CO is evolved there. The remaining one-third of the CO is evolved when the second liquid decomposes into the first liquid 17 in the zone 14. Steps are taken to assure that the CO evolved in the formation of the first liquid 12 from the $Al_2O_3 + C$ charge does not pass through the second liquid 17. Rather, this two-thirds of the CO passes directly, as indicated by arrow A, from the surface of the first liquid 12 to the exhaust to pass countercurrent through the incoming charge. By skirting this two-thirds around the second liquid 17, volatilization losses from liquid 17 are minimized, such losses being roughly proportional to the amount of gas sweeping through liquid 17.

The CO which is evolved on the decomposition of the first liquid 12 into the second liquid 17 represents one-third of the total quantity of CO and this likewise goes, as indicated by arrows $B_1$ and $B_2$, to the exhaust to pass countercurrent through the incoming charge.

This countercurrent movement of the evolved CO and entrained volatilized material from the first and second liquids causes the release of stored energy therein to the incoming charge. The noncondensable gas is simply lowered in temperature, the heat there being given to the incoming charge, while volatilized material from the first and second liquids condenses and even back reacts with the CO, also to heat up the incoming $Al_2O_3 + C$ charge.

Although the embodiment of FIG. 7 is continuous, it may be run batchwise, essentially by removing tube 13, controlling temperature to first form all first liquid, waiting until all the CO evolution from the first liquid is through, and then raising the temperature to decompose the first liquid into the second liquid. While there would be no feeding of charge during the second stage, the evolved CO could still be passed through charge which would be fed later.

Referring now to FIG. 8, that embodiment of the invention shows the use of a setup wherein the necessary heat required to attain the desired temperatures in the first liquid 42 and the second liquid 47 is achieved by an arc impinging onto the second liquid 47 from carbon electrode 80. The electrode of opposite polarity is electrode 81. While this heating from electricity is primarily through the use of an arc, it will be recognized that completely electrical resistance heating, by only passing an electrical current through the liquids, would be an alternative method of supplying the required heat to the liquids and for creating an increased temperature in the zone 44 of increased temperature in the first liquid 42.

In this embodiment, the cooler region of the first liquid 42 is on the outside, this cooler region having a doughnut shape due to the cylindrical symmetry of the structure about the axis running through the carbon electrode 80. The zone 44 is at an increased temperature relative to the outer cooler region of the first liquid 42 due to its being closer to the arc between the end of carbon electrode 80 and the upper surface of the second liquid 47.

In a manner analogous to what is shown in FIG. 7, two-thirds of the CO passes straight upwards, as indicated by arrows $A_1$ and $A_2$, to move countercurrent through the incoming charge 40 of $Al_2O_3 + C$ in conduit 41, without passing through the second liquid 42, while the remaining one-third of the CO evolved during decomposition moves along the paths of arrows $B_1'$ and $B_2'$, into the charge also, to provide the recapture of volatilized materials from the second liquid.

It will be noted that CO gas is a by-product of the process of the present invention, and can be used as a low BTU gas for a multitude of purposes. The process of the present invention even represents a method of coal gasification, wherein the coal would be present as the carbon in the charge. It would be preferable however that the coal be first purified, since it would in general be more difficult to later remove impurities brought in by the coal from the aluminum product.

It will be understood that the above description of the present invention is susceptible to various modifications, changes, and adaptations and the same are intended to be comprehended within the meaning and range of equivalence of the appended claims.

What is claimed is:

1. A process for producing aluminum, comprising the steps of forming from $Al_2O_3$ and C in the ratio one mol $Al_2O_3$ to 3 mols C, a first liquid of $Al_2O_3$ and $Al_4C_3$ accompanied by the evolution of gases, creating in said first liquid a zone of increased temperature and/or decreased pressure to decompose said first liquid to a second liquid of Al and C, exhausting said gases during the step of forming said first liquid without said gases passing through said second liquid, and recovering Al from said second liquid.

2. A process as claimed in claim 1, wherein the step of creating said zone includes supplying heat to said zone from electricity.

3. A process as claimed in claim 2, wherein the step of creating said zone includes supplying heat to said zone from an electric arc.

4. A process as claimed in claim 1, wherein the step of creating said zone includes supplying heat to said zone from a nuclear reactor.

5. A process as claimed in claim 1, wherein the temperature, pressure, and composition in said zone lie on the locus of minima of the fraction of aluminum vaporizing or back reacting curves plotted in the phase field of said first liquid in the phase diagram as depicted in FIG. 5 of the binary $Al_2O_3$-$Al_4C_3$.

6. A process as claimed in claim 5, wherein the conditions in said zone are as follows:

temperature = 2370°K,
pressure = 1 atmosphere, and
the mol fraction $$\frac{Al_2O_3}{Al_2O_3 + Al_4C_3} = 0.85.$$

7. A process as claimed in claim 6, wherein the first liquid is initially formed by providing $Al_2O_3$ and C in the ratio 0.85 mols $Al_2O_3$ to 1.00 mols C and heating these components to 2320°K.

8. A process as claimed in claim 5, wherein the pressure in said zone is above atmospheric pressure.

9. A process as claimed in claim 1, wherein exhaust gases from the forming of said first liquid and from the decomposing of said first liquid to said second liquid are passed through the $Al_2O_3$ and C being charged to the step of forming, in countercurrent fashion, for causing condensation of gaseous material onto the $Al_2O_3$-C charge to prevent loss of such material and to recover the stored energy therein by such condensation and by back reaction.

* * * * *

UNITED STATES PATENT AND TRADEMARK OFFICE

CERTIFICATE OF CORRECTION

PATENT NO. : 3,971,653

DATED : July 27, 1976

INVENTOR(S) : C. Norman Cochran

It is certified that error appears in the above-identified patent and that said Letters Patent are hereby corrected as shown below:

| | |
|---|---|
| Col. 1, line 60 | After "The" change "loses" to --losses--. |
| Col. 2, line 30 | After "(as from a" add --container)--. |
| Col. 2, line 30 | After "contacts" delete "cntacts". |
| Col. 4, line 17 | After "and" change "$C_{3(c)}$" to --$C_{(c)}$--. |
| Col. 5, line 37 | After "lines" change "(1,2,6)" to --(1,2,6)--. |
| Col. 5, line 55 | Change the equation number "(3)" to --(1)--. |
| Col. 6, line 3 | After "$Al_{(g)}$" change "and Al2O(g)" to --and $Al_2O_{(g)}$--. |
| Col. 6, line 33 | After "+" change "$3C_{(L)}$" to --$3C_{(\ell)}$--. |
| Col. 7, line 10 | Change "pCO" to --$p_{CO}$--. |
| Col. 7, line 10 | Change "$P_{Al_2O}$" to --$p_{Al_2O}$--. |
| Col. 7, line 61 | After "carbon" change "about" to --above--. |
| Col. 8, line 34 | After "+" (second occurrence) change "$P_{Al}/P_{Al}$" to --$p_{Al}/p_{Al}$--. |

UNITED STATES PATENT AND TRADEMARK OFFICE

CERTIFICATE OF CORRECTION

PATENT NO. : 3,971,653

DATED : July 27, 1976

INVENTOR(S) : C. Norman Cochran

It is certified that error appears in the above-identified patent and that said Letters Patent are hereby corrected as shown below:

| | |
|---|---|
| Col. 8, line 62 | After "at" change "abot" to --about--. |
| Col. 10, line 47 | After "to" change "flollow" to --follow--. |
| Cols. 13-14, TABLE I Col. entitled "$Al_4C_{3(\ell)}$ (1)" | After "91.714" add --93.027--. |
| Cols. 13-14, TABLE II, third line in table heading | After "TEMPERATURE" change "ON" to --OR--. |
| Cols. 13-14, TABLE II, Under heading "Al-C System", first line under "<u>liquidus lines</u>:" | Change "ln $a_{Al_4C_3}$" to --ln $a_{Al_4C_{3(\ell)}}$--. |
| Cols. 13-14, TABLE II, Under heading "Al-C System", first line under "<u>liquidus lines</u>:" | After "to" change "240°K" to --2408°K--. |
| Cols. 13-14, TABLE II, Under heading "Al-C System", first line under "<u>for any composition or temperature in liquid</u>:" | After "ln", in the denominator of the fraction change "$a_{Al_4C_3}$" to --$a_{Al_4C_{3(\ell)}}$--. |

UNITED STATES PATENT AND TRADEMARK OFFICE

CERTIFICATE OF CORRECTION

PATENT NO. : 3,971,653

DATED : July 27, 1976

INVENTOR(S) : C. Norman Cochran

It is certified that error appears in the above-identified patent and that said Letters Patent are hereby corrected as shown below:

| | |
|---|---|
| Cols. 13-14, TABLE II, Under heading "$Al_2O_3$-$Al_4C_3$ System", third line under "liquidus lines:" | Change "$\frac{56.355}{RT}$" to --$\frac{56,355}{RT}$--. |
| Cols. 13-14, TABLE II, Under heading "$Al_2O_3$-$Al_4C_3$ System", fourth line under "liquidus lines:" | After "$a_{C_{(\ell)}} + a_{Al_4C_{3_{(\ell)}}} + a_{Al_{(\ell)}}$" add --=-- (equal sign). |
| Cols. 15-16, TABLE III, Footnote "(3)" | After "Decomposition of Liquid" add --1--. |
| Col. 20, line 60 (Claim 5) | Before "fraction" add --"--. |
| Col. 20, line 61 (Claim 5) | After "reacting" add --"--. |
| Col. 5, line 33 | Insert --the-- between "above" and "2408°K". |
| Col. 6, line 57 | Change "equilibrium" to --equilibria--. |
| Col. 12, line 32 | Change "Pdgeon" to --Pidgeon--. |

UNITED STATES PATENT AND TRADEMARK OFFICE

CERTIFICATE OF CORRECTION

PATENT NO. : 3,971,653

DATED : July 27, 1976

INVENTOR(S) : C. Norman Cochran

It is certified that error appears in the above-identified patent and that said Letters Patent are hereby corrected as shown below:

| | |
|---|---|
| Cols. 15-16, TABLE III, In the heading "Calculated Liquid Composition $N_{Al\ O}$" | Change "$N_{Al\ O}$" to --$N_{Al_2O_3}$--. |
| Figure 4 of the drawing | Before "AND Al (ATMOSPHERES)" Change "$Al_2O_3$" to --$Al_2O$--. |

Signed and Sealed this

First Day of February 1977

[SEAL]

*Attest:*

RUTH C. MASON
*Attesting Officer*

C. MARSHALL DANN
*Commissioner of Patents and Trademarks*